US005462106A

United States Patent [19]

Hanna

[11] Patent Number: 5,462,106

[45] Date of Patent: Oct. 31, 1995

[54] METHOD OF PRODUCING A MOLD OPEN RISER IN MOLD DURING CASTING

[76] Inventor: Paul E. Hanna, 4 Brandywine Cir., Greensboro, N.C. 27409

[21] Appl. No.: 251,128

[22] Filed: May 31, 1994

[51] Int. Cl.[6] ..... B22C 9/08

[52] U.S. Cl. ..... 164/15; 164/34; 164/359

[58] Field of Search ..... 164/34, 35, 36, 164/15, 162, 246, 359, 360

[56] References Cited

U.S. PATENT DOCUMENTS 3,273,211 9/1966 Miraldi ..... 164/359

*Primary Examiner*—Kuang Y. Lin

*Attorney, Agent, or Firm*—John R. Benefiel

[57] ABSTRACT

A method of forming an open riser in a mold includes telescoping a heat consumable tapered plug into the upper end of a riser sleeve, which projects above the riser sleeve and cope sand level so as to be advanced into the riser sleeve during squeezing of the mold sand. The plug is vaporized or consumed by hot metal during casting, creating an open riser.

4 Claims, 1 Drawing Sheet

METHOD OF PRODUCING A MOLD OPEN RISER IN MOLD DURING CASTING

BACKGROUND OF THE INVENTION

Field of the Invention

This invention concerns casing methods, and more particularly a method of creating an open riser in a mold during casing.

Description of the Prior Art

Molds often incorporate one or more "riser" passages extending vertically up from a mold cavity, allowing liquid metal to rise within the riser passage when molten metal is poured into the cavity through a down sprue. The purpose of the metal in riser is to prevent shrinkage from occurring during solidification by allowing shrinkage to be made up by met from the riser.

Insulating and exothermic riser sleeves are often used to keep the metal in the riser liquid to allow a shrinkage make up flow of metal back into the mold cavity.

Blind risers are those riser passages which do not open to outside of the mold, and these have sometimes been formed by burying a polystyrene similar heat consumable material mass in mold sand which gasifies upon contact with the hot metal to allow the metal to rise into the blind riser.

See for examples U.S. Pat. No. 3,602,292 issued on Aug. 31, 1971 for "Casing Molds Having Decomposable Hollow Risers"; U.S. Pat. No. 4,140,838 issued on Feb. 20, 1979 for "Sand Mold Risers"; and U.S. Pat. No. 5,271,451 issued on Dec. 21, 1993 for a "Metal Casing Using a Mold Having Attached Risers".

It sometimes is desirable to have an "open" riser which extends to the outside of the mold so that additional metal can be poured into a riser as needed to insure that shrinkage completely made up.

However, when a mold is being made by an automatic matchplate molding machine or a cope and drag type molding machine the squeezing of the mold sand makes it impossible to form the open riser without the possibility of dislodging mold sand which can then drop into the mold cavity as the squeeze process proceeds.

A manual or separate automatic cutting operation is also required.

It is the object of the present invention to provide a method of forming an open riser passage in a mold which is constructed by a process including a mold sand squeezing operation.

SUMMARY OF THE INVENTION

The present invention comprises the use of a tapered consumable plug which is press fitted so as to be telescoped into the upper end of a riser sleeve extending into the mold cavity. The plug blocks the upper end of the riser sleeve but projects above the level of the cope sand so as to be engaged against an upper squeeze plate. As the mold sand is compressed against the squeeze plate, the consumable plug is advanced into the riser sleeve, maintaining a sealed environment for the interior of the riser sleeve.

Upon pouring molten metal into the mold cavity, hot metal rises in the riser sleeve, contacting and vaporizing the plug, creating an open riser passage.

The tapered riser plug is preferably constructed of expanded polystyrene or similar heat consumable material, which is readily vaporized during casting.

DETAILED DESCRIPTION

In the following detailed description, certain specific terminology will be employed for the sake of clarity and a particular embodiment described in accordance with the requirements of 35 USC 112, but it is to be understood that the same is not intended to be limiting inasmuch as the invention is capable of taking many forms and variations within the scope of the appended claims.

Figure 1:
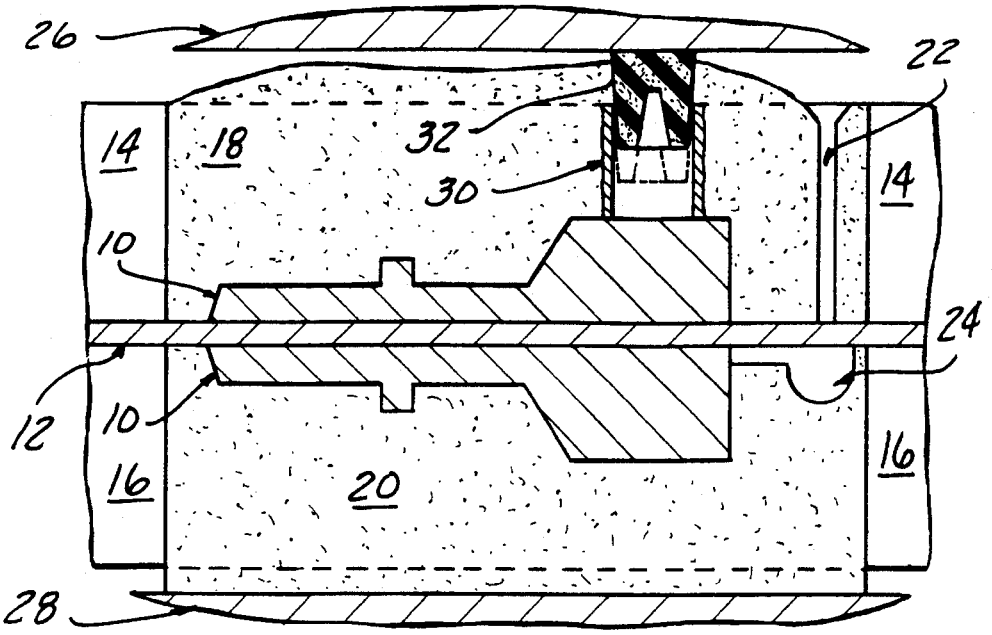
FIG. 1 is a sectional diagrammatic view of a mold being made showing the riser sleeve plug in an initial position and in phantom in an advanced position after squeezing of the cope sand is completed.

Referring to the drawings and particularly FIG. 1, pattern 10 and pattern board 12 are shown in position within a cope flask 14 and drag flask 16.

A volume of sand 18 is contained in cope flask 14 and, as well as a volume of sand 20 in the drag flask 16.

Conventional means (not shown) are provided for forming a down sprue 22 and in gate 24.

The conventional mold machine in which the mold making is to be carried out includes an upper fixed squeeze plate 26 and an upwardly movable bottom plate 28.

The volume of sand in the cope flask 14 and the volume 18 of sand 20 in the drag flask 16 are both compacted by upward movement of the lower plate 28 until the upper and lower plates 26, 28 approach contact with the cope flask 14 and drag flask 16 respectively.

A conventional riser sleeve 30 is disposed against the largest volume region of the pattern 10, extending upwardly partially through the cope sand volume 18.

According to the concept of the present invention, a tapered heat consumable plug 32 is sealingly press fitted so as to be telescoped into the upper end of riser sleeve 30. The heat consumable plug 32 has an upper end which projects above the top of the volume of sand 18 in the cope flask 14 and engages the squeeze plate 26.

Figure 2:
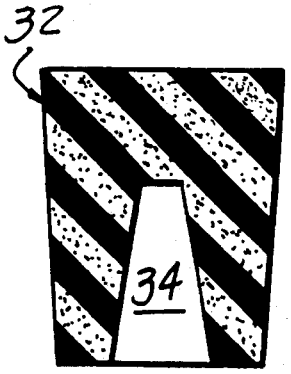
FIG. 2 is an enlarged sectional view through the riser sleeve plug.
Figure 3:
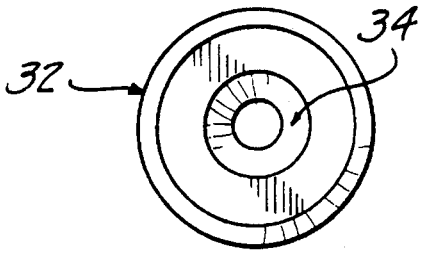
FIG. 3 is an end view of the riser sleeve plug shown in FIG. 2.

The plug 32 may be constructed of expanded polystyrene or similar heat consumable material, and as shown in FIGS. 2 and 3, is preferably formed with a tapered bore 34 extending upwardly from the lower end to facilitate vaporizing by contact with the hot metal during casting.

During mold making, the plug 32 is driven down into the rise sleeve 30 as the mold sand is compacted, reaching an advanced position shown in phantom in FIG. 1. The tapered configuration of the plug 32 maintains a sealing interfit with the riser sleeve 30 as the plug 32 is driven into the riser sleeve 30. This maintains a sealed environment within the riser sleeve 30 preventing any sand or dirt from entering the mold cavity.

Figure 4:
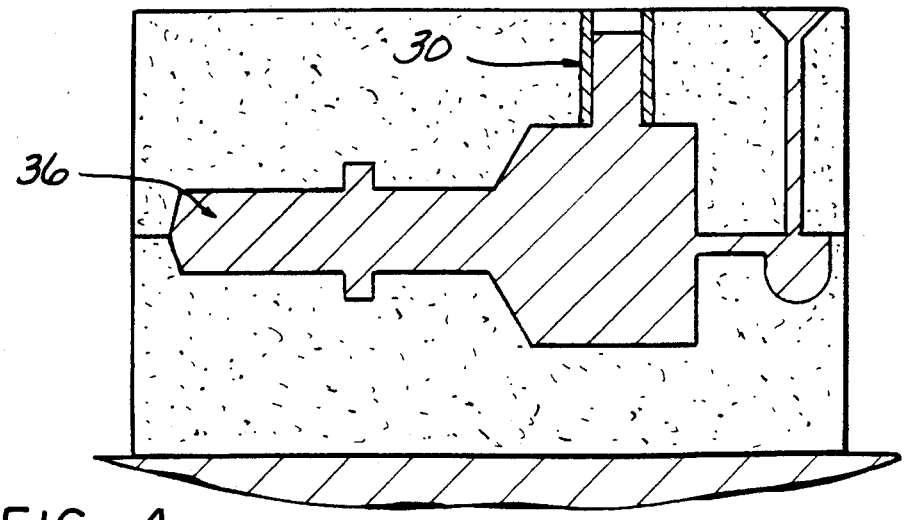
FIG. 4 is a sectional view of a mold made according to the process according to the invention, with molten metal poured into the cavity and having risen into the riser sleeve, the riser plug having been vaporized by the metal.

Referring to FIG. 4, during casting the metal 36 rises from the mold cavity into the riser sleeve 30, vaporizing the consumable plug 32, creating an open riser, allowing the riser to be topped off with additional metal, as needed.

I claim:

1. A method of forming an open riser in a mold, comprising the steps of installing a riser sleeve within the cope sand extending against a mold pattern;

telescoping a heat consumable plug into an upper end of said riser sleeve so as to be partially press fitted therein with a portion thereof projecting above said upper end of said riser sleeve and the level of said cope sand; and pushing said plug further into said riser sleeve as said cope sand is squeezed in constructing said mold, whereby up consuming of said plug by hot metal during casting, an open riser is produced.

2. The method according to claim 1 wherein said plug is abutted against a squeeze plate to be forced into said riser sleeve as said cope sand is compressed thereagainst.

3. The method according to claim 1 wherein said plug is tapered to be sealingly interfit with said riser sleeve during said advance thereinto.

4. The method according to claim 1 further including the step of constructing said plug of expanded polystyrene to be heat consumable.

* * * * *

UNITED STATES PATENT AND TRADEMARK OFFICE

CERTIFICATE OF CORRECTION

PATENT NO. : 5,462,106
DATED : October 31, 1996
INVENTOR(S) : Paul E. Hanna

It is certified that error appears in the above-indentified patent and that said Letters Patent is hereby corrected as shown below:

Column 1, line 7, "casing" should be --casting--.

Column 1, line 9, "casing" should be --casting--.

Column 1, line 18, "met" should be --melt--.

Column 1, line 23, "outside" should be --the outside--.

Column 1, line 28, "Casing" should be --Casting--.

Column 1, line 31, "Casing" should be --Casting--.

Column 1, line 36, "completely" should be --is completely--.

Column 2, line 57, "rise" should be --riser--.

Column 3, line 11 (Claim 1), "up" should be --upon--.

Signed and Sealed this

Twenty-second Day of April, 1997

Bruce Lehman

*Attest:*

BRUCE LEHMAN

*Commissioner of Patents and Trademarks*

*Attesting Officer*